US009879505B2

(12) United States Patent
Holloway et al.

(10) Patent No.: US 9,879,505 B2
(45) Date of Patent: Jan. 30, 2018

(54) ONE TRIP WELLBORE CLEANUP AND SETTING A SUBTERRANEAN TOOL METHOD

(71) Applicant: BAKER HUGHES INCORPORATED, Houston, TX (US)

(72) Inventors: James L. Holloway, Spring, TX (US); Samuel K. Kruger, Spring, TX (US); Christopher R. Matthews-Ewald, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 334 days.

(21) Appl. No.: 14/687,245

(22) Filed: Apr. 15, 2015

(65) Prior Publication Data

US 2016/0305219 A1 Oct. 20, 2016

(51) Int. Cl.

| | |
|---|---|
| ***E21B 37/00*** | (2006.01) |
| ***E21B 33/12*** | (2006.01) |
| ***E21B 37/02*** | (2006.01) |
| ***E21B 23/06*** | (2006.01) |

(52) U.S. Cl.

CPC ..... *E21B 37/00* (2013.01); *E21B 23/06* (2013.01); *E21B 33/12* (2013.01); *E21B 37/02* (2013.01)

(58) Field of Classification Search

CPC ..... E21B 37/00; E21B 37/02; E21B 33/12; E21B 23/06

See application file for complete search history.

(56) References Cited

U.S. PATENT DOCUMENTS 2,912,053 A * 11/1959 Breukelman ..... E21B 33/134 166/146
3,105,555 A * 10/1963 Villalon, Jr. ..... E21B 37/02 15/104.16
3,434,538 A * 3/1969 Pumpelly ..... E21B 23/006 166/123
3,981,364 A * 9/1976 Warner ..... E21B 34/12 166/174
4,928,762 A * 5/1990 Mamke ..... E21B 23/006 166/119
5,343,956 A * 9/1994 Coronado ..... E21B 33/127 166/123

(Continued)

FOREIGN PATENT DOCUMENTS

WO WO 2016168643 A1 * 10/2016 ..... E21B 23/06

*Primary Examiner* — Jennifer H Gay
(74) *Attorney, Agent, or Firm* — Steve Rosenblatt

(57) ABSTRACT

A one trip method of cleaning a portion of the borehole and then setting a tool such as a packer or a bridge plug locates the cleanup tools above the plug with a ported sub to allow circulation of loosened debris. The debris is directed uphole from above the plug and does not have to pass around the sealing element of the plug or through bypass ports in the plug body. The plug is then positioned in the cleaned portion and set. The cleaning tools are released from the set plug and brought to the surface. These tools could be used to clean the portion of the borehole where the tool is set or clean the entire section above the tool on the trip out of the borehole. Cleaning tools can be filter, scrapers both fixed and movable, magnets, brushes and associated tools that centralize the assembly for more effective operation.

14 Claims, 1 Drawing Sheet

(56) References Cited

U.S. PATENT DOCUMENTS 5,697,449 A * 12/1997 Hennig ..... E21B 33/1294 166/124
6,896,064 B2 5/2005 Howlett et al.
7,096,950 B2 8/2006 Howlett et al.
7,562,703 B2 7/2009 Palmer et al.
8,347,968 B2 1/2013 Debard et al.
2003/0132007 A1* 7/2003 Howlett ..... E21B 47/1025 166/387
2004/0094302 A1* 5/2004 Booth ..... E21B 37/02 166/311
2004/0112588 A1* 6/2004 Mullins ..... E21B 37/00 166/177.3
2004/0177967 A1* 9/2004 Hirth ..... E21B 33/12 166/311
2007/0039737 A1* 2/2007 Telfer ..... E21B 43/10 166/311
2008/0223580 A1* 9/2008 Anderson ..... E21B 21/00 166/312
2009/0120633 A1* 5/2009 Webb ..... E21B 33/1243 166/249
2009/0272524 A1 11/2009 Voth
2010/0096122 A1* 4/2010 Posevina ..... E21B 37/02 166/173
2010/0175894 A1* 7/2010 Debard ..... E21B 43/08 166/382
2011/0108266 A1* 5/2011 Smith ..... E21B 23/00 166/208
2011/0168404 A1 7/2011 Telfer et al.
2011/0290334 A1* 12/2011 Hern ..... E21B 27/005 137/15.04
2012/0211229 A1 8/2012 Fielder et al.
2012/0222861 A1 9/2012 Eriksen
2013/0192818 A1* 8/2013 Winn ..... E21B 37/02 166/173
2014/0246239 A1* 9/2014 Abdel-Baky ..... E21B 21/103 175/57
2015/0114654 A1* 4/2015 Monjure ..... E21B 41/00 166/311
2016/0305219 A1* 10/2016 Holloway ..... E21B 23/06
2016/0312582 A1* 10/2016 Ali ..... E21B 37/00

* cited by examiner

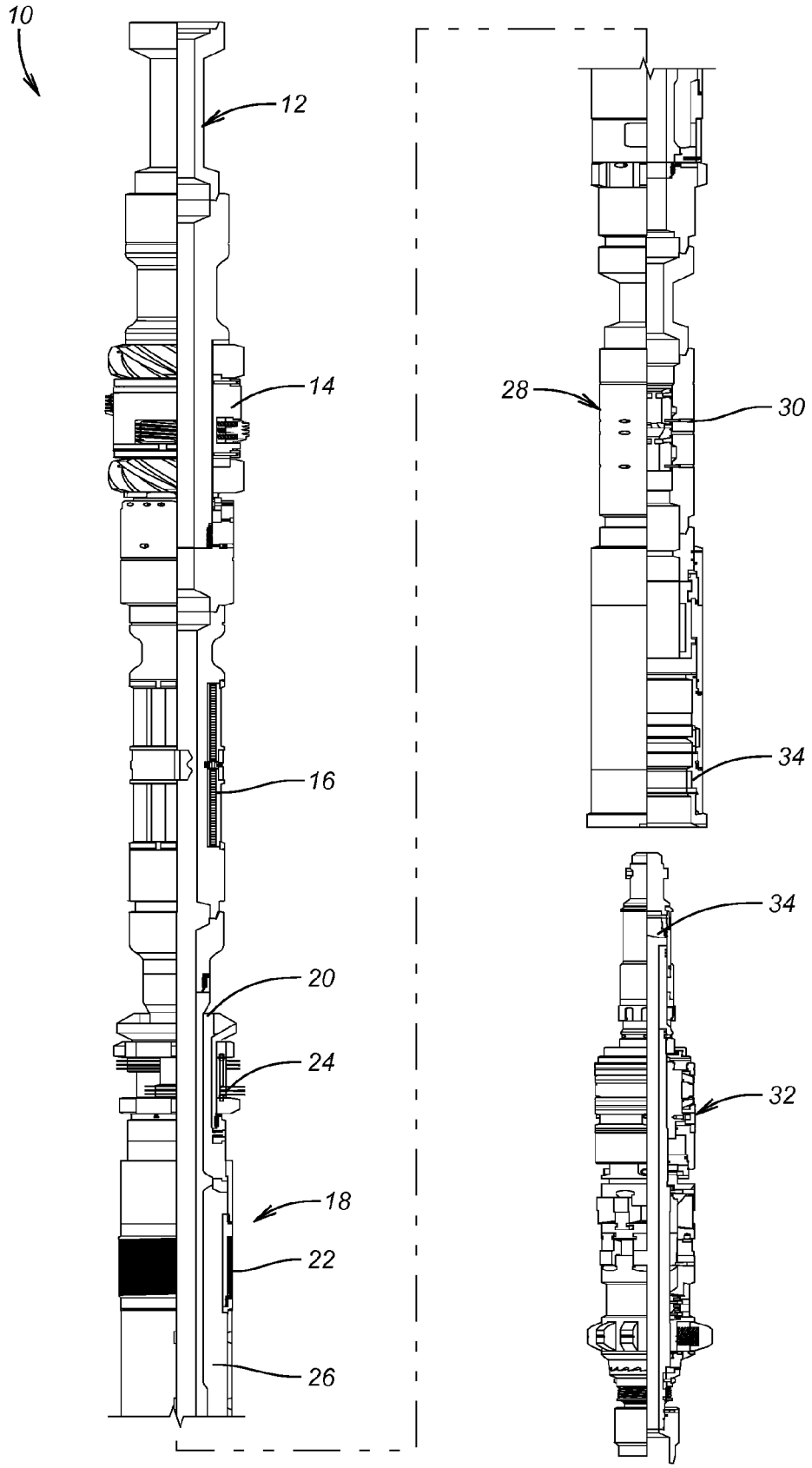
10
12
14
16
20
24
18
22
26
28
30
34
34
32

ONE TRIP WELLBORE CLEANUP AND SETTING A SUBTERRANEAN TOOL METHOD

FIELD OF THE INVENTION

The field of the invention is one trip systems that effectively clean the borehole while delivering a tool to be set and then positioning the tool in the cleaned portion of the well for actuation which releases the running string from the tool for removal of the cleaning tool or tools.

BACKGROUND OF THE INVENTION

Residue accumulates on tubular walls in borehole from drilling mud or well fluids. This residue needs to be removed before setting tools against an existing tubular in the borehole. More often than not a separate trip is made to clean the well before running in and setting the tool in question. Using two trips takes a lot of time and costs money so a one trip approach is a logical goal of streamlining the process.

One approach to the solution has been to simply circulate the well with the tool in the hole with the hope that circulation will do a good enough job in the zone where the tool is to be set. This technique is shown in U.S. Pat. No. 8,347,968 and suffers from an inability to focus on a small portion of a wellbore where the tool is to be set and the spotty effectiveness of circulation as a technique for effectively removing debris from a specific portion of the well where such removal is most critical.

One method has combined milling and scraping but while mentioning a packer in passing to be set in a polished bore, it does not indicate that the packer is delivered in the same trip as the milling and scraping tools. That reference is U.S. Pat. No. 7,096,950.

U.S. Pat. No. 6,896,064 illustrates a cleanup tool mounted below a packer with the purpose of cleaning the wellbore and then setting the packer in a single trip. There are several issues with this design that discloses a fixed dimension scraper immediately below the packer. One is that the loosened debris will need to be passed around the packer sealing element or through bypasses built into the mandrel body of the packer. Either way there is a serious chance that the packer will become stuck as debris tries to get around or through it even before it is set. Debris can stick to the outside of the packer element preventing it from getting a good seal. Once the cleaning is done and the packer is set, the cleaning tools are still hanging on the underside of the packer and may later also require milling out whether still supported by the packer or even if dropped to the hole bottom in the event there is a further extension of the borehole.

The cleaning tools theoretically could also be retrieved in the event that the tool is a retrievable packer/bridge plug. However, retrieval could be extremely difficult if the tool is exposed to wellbore fluids for an extended amount of time, which could limit the ability of scrapers to expand and contract to different wellbore geometries.

The shortcomings described above are avoided with the present invention where the cleaning tools are located above the packer or plug or other tool to be set, with a disconnect in between so that the running string and the cleaning equipment can be released and removed from the borehole. By incorporating a circulation sub also above the packer and below the cleaning equipment, the loosened debris can be circulated out uphole of the packer to spare the packer or plug the issue of potential sticking with debris that has to pass by or through it as in U.S. Pat. No. 6,896,064. Those skilled in the art will have a better understanding of the invention from a review of the description of the preferred embodiment and the associated drawing while appreciating that the full scope of the invention is to be determined from the appended claims.

SUMMARY OF THE INVENTION

A one trip method of cleaning a portion of the borehole and then setting a tool such as a packer or a bridge plug locates the cleanup tools above the plug with a ported sub or a ball actuated circulation valve to allow circulation of loosened debris. The debris is directed uphole from above the plug and does not have to pass around the sealing element of the plug or through bypass ports in the plug body. The plug is then positioned in the cleaned portion and set. The cleaning tools are released from the set plug and brought to the surface. Cleaning tools can be filter, scrapers both fixed and movable, magnets, brushes and associated tools that centralize the assembly for more effective operation. In an alternative use the cleaning tools can be activated on the trip out of the borehole either with the packer or plug if it is retrievable or without it if it is not retrievable.

BRIEF DESCRIPTION OF THE DRAWING

The Figure is a part section and part exterior view of the assembly of the plug and the cleaning equipment located uphole of the plug.

DETAILED DESCRIPTION OF THE PREFERRED EMBODIMENT

A bottom hole assembly (BHA) 10 is supported by a string 12 at a desired location in a borehole that is not shown. A non-rotating casing scraper 14 is shown above magnets 16. A wellbore filter assembly 18 is further downhole and it comprises an inlet 20 and a screened outlet 22. The brushes 24 are oriented to bypass flow for running in the hole and to line up to redirect flow into inlet 20 when the BHA 10 is pulled uphole. Chamber 26 holds the collected and diverted debris on movement uphole of the BHA 10.

Item 28 is a schematically represented ported sub or circulation valve assembly that can be as simple as an inline valve or preferably have a selectively opened side port 30 so that in some BHAs 10 where it is desired to circulate while cleaning the borehole such circulation can take place above the bridge plug 32 and a disconnect 34 that is immediately above the bridge plug 32.

While cleaning can take place on the trip into the wellbore the preferred method is to bring the plug 32 rapidly to beyond where it will ultimately be set. At this point the cleaning equipment that can be radially extend or otherwise manipulated into cleaning mode can be put in that mode and movement uphole can commence to cover at least the intended setting location for the plug 32. Once that zone of the borehole is cleaned the plug 32 is positioned in the cleaned zone and set and released at disconnect 34 allowing the string 12 to take with it the cleaning equipment down to the upper part of the disconnect 34.

Those skilled in the art will appreciate that a one trip method allows borehole cleanup for the length of an existing tubular or a part thereof with string movement in either direction with a tool to then be set later in the cleaned portion of the borehole as part of the bottom hole assembly. The loosened debris is preferably circulated out in a manner where it doesn't have to flow through or past the tool. The tool is preferably a packer or bridge plug. A ported sub located above the tool allows debris to be circulated out at a distance from the tool to better insure that the tool operates reliably after the cleaning.

The BHA can use one or more known cleaning tools with a disconnect that can be actuated with a dropped ball on a seat with applied pressure or with string manipulation, to name a few possibilities. In that manner the BHA is removable with the tool such as a plug set in a borehole for abandonment. Other tools such as anchors for whipstocks for example can be the tool run in on a single trip. Centralizers can be integrated with the cleanup tools to enhance their performance. As an alternative the cleaning can be accomplished in a different location than where the tool is set such as setting a packer in an un-cleaned portion and releasing the cleaning tools from the set packer to clean above or uphole of the set packer or plug.

The plug or packer can be retrievable in which case the packer or plug can be removed at a later time or even with the cleaning equipment. The cleaning equipment can be operated with circulation on the trip out of the hole after the plug or packer are set.

The above description is illustrative of the preferred embodiment and many modifications may be made by those skilled in the art without departing from the invention whose scope is to be determined from the literal and equivalent scope of the claims below:

We claim:

1. A completion method, comprising:

cleaning at least a portion of a borehole with cleaning equipment comprising part of a bottom hole assembly further including a subterranean tool;

axially aligning cleaning elements of said cleaning equipment with an uphole movement of said bottom hole assembly such that said cleaning elements, when aligned, redirect flow when pulled uphole as opposed to bypassing flow when run in the hole;

fixating said subterranean tool in the location cleaned by said cleaning equipment;

removing said cleaning equipment from the borehole after said fixating.

2. The method of claim 1, comprising:

accomplishing said cleaning in a location where said subterranean tool is to be actuated;

locating said cleaning equipment uphole from said subterranean tool.

3. The method of claim 2, comprising:

providing a disconnect between said subterranean tool and said cleaning equipment to facilitate said removing.

4. The method of claim 3, comprising:

providing a circulation valve or ported sub between said disconnect and said cleaning equipment for removal of debris toward a surface location with pumped circulation through a string that supports said subterranean tool and said cleaning equipment.

5. The method of claim 4, comprising:

avoiding flowing released debris past or through said subterranean tool when circulating fluid through said string.

6. The method of claim 5, comprising:

using a packer or plug as said subterranean tool.

7. The method of claim 6, comprising:

using at least one of a magnet, brush, fixed or movable scraper and a well filter as said cleaning equipment.

8. The method of claim 1, comprising:

providing a disconnect between said subterranean tool and said cleaning equipment to facilitate said removing.

9. The method of claim 8, comprising:

providing a ported sub between said disconnect and said cleaning equipment for removal of debris with circulation through a string that supports said subterranean tool and said cleaning equipment.

10. The method of claim 1, comprising:

avoiding flowing released debris past or through said subterranean tool when circulating fluid through a supporting string.

11. The method of claim 1, comprising:

using a packer or plug as said subterranean tool.

12. The method of claim 11, comprising:

removing said plug or packer with said cleaning equipment or in a separate trip at a time after said cleaning equipment has been removed.

13. The method of claim 11, comprising:

operating said cleaning equipment after release from said plug or packer.

14. The method of claim 1, comprising:

using at least one of a magnet, brush, fixed or movable scraper and a well filter as said cleaning equipment.

* * * * *